US012116239B2

(12) United States Patent
Eguchi et al.

(10) Patent No.: US 12,116,239 B2
(45) Date of Patent: Oct. 15, 2024

(54) MEDIUM TRANSPORT DEVICE AND IMAGE FORMING APPARATUS

(71) Applicant: FUJIFILM Business Innovation Corp., Tokyo (JP)

(72) Inventors: Hirotake Eguchi, Kanagawa (JP); Nobuhiro Hiroe, Kanagawa (JP); Koji Deguchi, Kanagawa (JP); Kiyoshi Watanabe, Kanagawa (JP); Yasunobu Goto, Kanagawa (JP); Yoshinori Koike, Kanagawa (JP); Natsumi Nakata, Kanagawa (JP); Yoshiki Matsuzaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 141 days.

(21) Appl. No.: 17/940,300

(22) Filed: Sep. 8, 2022

(65) Prior Publication Data

US 2023/0312293 A1 Oct. 5, 2023

(30) Foreign Application Priority Data

Mar. 29, 2022 (JP) ..... 2022-052728

(51) Int. Cl.
*B65H 9/00* (2006.01)
*B65H 9/16* (2006.01)

(52) U.S. Cl.
CPC ..... *B65H 9/166* (2013.01); *B65H 2801/06* (2013.01)

(58) Field of Classification Search
CPC ..... B65H 9/166; B65H 2801/06; B65H 9/00; B65H 9/002; B65H 9/106
See application file for complete search history.

(56) References Cited

U.S. PATENT DOCUMENTS

| | | | | |
|---|---|---|---|---|
| 7,753,370 | B2 | 7/2010 | Inoue | |
| 2007/0023995 | A1* | 2/2007 | Onodera | B65H 9/006 271/226 |
| 2009/0134570 | A1* | 5/2009 | Hayakawa | B65H 9/002 271/227 |
| 2011/0095472 | A1* | 4/2011 | Ishikawa | B65H 9/002 271/265.02 |
| 2012/0286468 | A1* | 11/2012 | Ui | B65H 9/002 271/227 |

FOREIGN PATENT DOCUMENTS

JP 2008-001473 A 1/2008

* cited by examiner

*Primary Examiner* — Thomas A Morrison
(74) *Attorney, Agent, or Firm* — Oliff PLC

(57) ABSTRACT

A medium transport device includes a positional corrector configured to transport a medium and correct a position of the medium in a width direction of the medium by moving the medium in the width direction, and an inclination corrector configured to transport the medium and correct an inclination of the medium relative to a transport direction of the medium on an upstream side of the positional corrector in the transport direction, the inclination corrector being disposed at a position where the medium is transported in a flat posture.

10 Claims, 7 Drawing Sheets

MEDIUM TRANSPORT DEVICE AND IMAGE FORMING APPARATUS

CROSS-REFERENCE TO RELATED APPLICATIONS

This application is based on and claims priority under 35 USC 119 from Japanese Patent Application No. 2022-052728 filed Mar. 29, 2022.

BACKGROUND

(i) Technical Field

The present disclosure relates to a medium transport device and an image forming apparatus.

(ii) Related Art

Japanese Unexamined Patent Application Publication No. 2008-1473 ([0036]-[0055], FIGS. 2, 5, 6, 9, 10) describes the following technology in a medium transport device that transports a medium before or after image printing.

Japanese Unexamined Patent Application Publication No. 2008-1473 describes a structure including skew correction rollers (21, 22) disposed away from each other in an axial direction and a pair of lateral registration rollers (30) on a downstream side of the skew correction rollers (21, 22). In Japanese Unexamined Patent Application Publication No. 2008-1473, in response to a nip of a sheet (S) by the skew correction rollers (21, 22), the lateral registration rollers (30) are separated so as not to nip the sheet (S). The transport speeds of the skew correction rollers (21, 22) are varied depending on a skew amount at the leading edge of the sheet (S) to correct the skew of the sheet (S). After the skew has been corrected, the sheet (S) is nipped by the lateral registration rollers (30) on the downstream side of the skew correction rollers (21, 22). After the skew correction rollers (21, 22) have been separated from the sheet (S), the lateral registration rollers (30) move in the axial direction to shift the positions of lateral edges of the sheet (S) to lateral registration positions.

SUMMARY

Aspects of non-limiting embodiments of the present disclosure relate to suppression of insufficiency of medium inclination correction compared with a case where the medium inclination correction is performed at a position where the medium is transported in a curved posture.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium transport device comprising: a positional corrector configured to transport a medium and correct a position of the medium in a width direction of the medium by moving the medium in the width direction; and an inclination corrector configured to transport the medium and correct an inclination of the medium relative to a transport direction of the medium on an upstream side of the positional corrector in the transport direction, the inclination corrector being disposed at a position where the medium is transported in a flat posture.

BRIEF DESCRIPTION OF THE DRAWINGS

An exemplary embodiment of the present disclosure will be described in detail based on the following figures, wherein.

DETAILED DESCRIPTION

Figure 1:
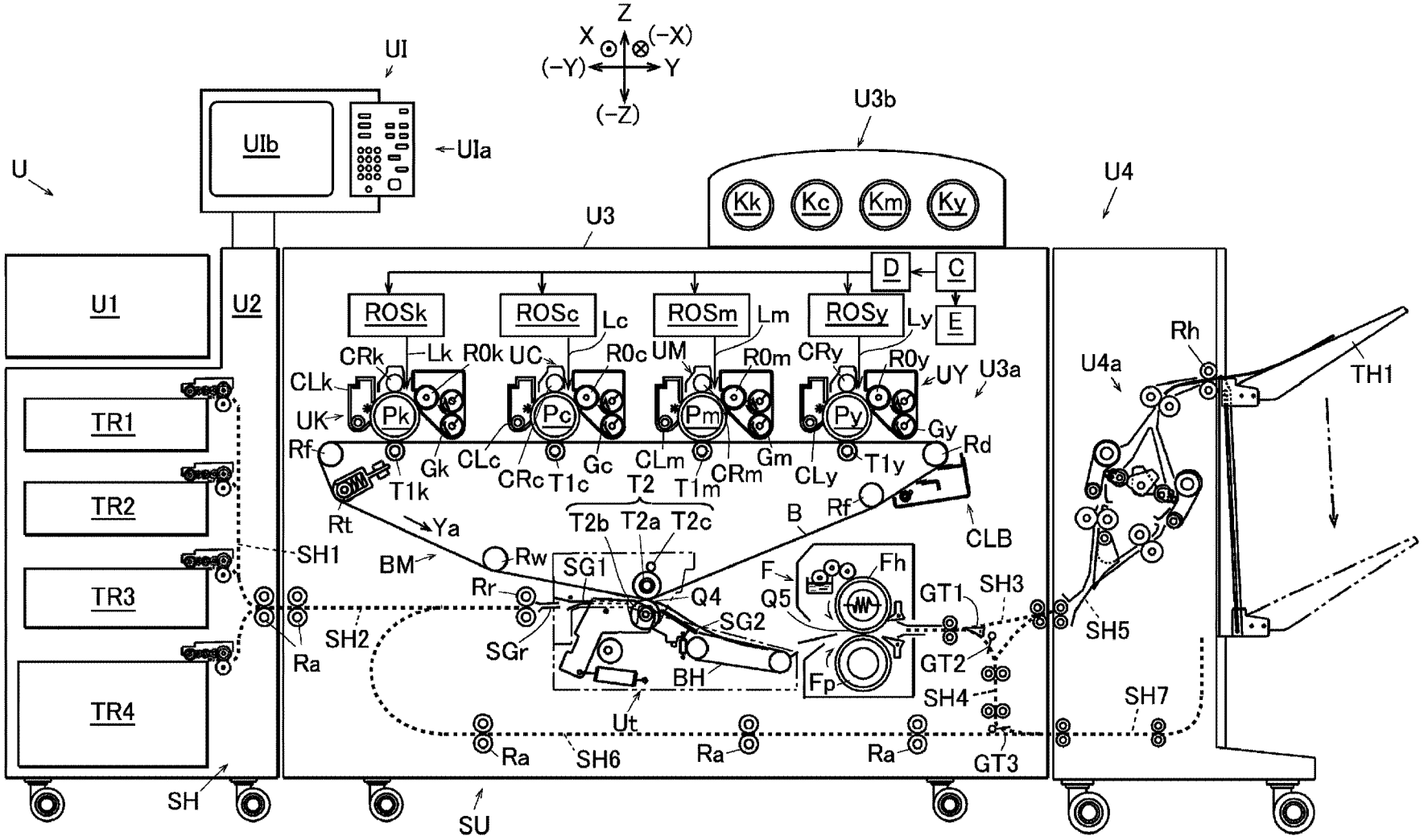
FIG. 1 illustrates an overall image forming apparatus of a first exemplary embodiment.

An exemplary embodiment of the present disclosure is described with reference to the drawings. The exemplary embodiment of the present disclosure is not limited to the following exemplary embodiment.

To facilitate understanding of the following description, the drawings illustrate a fore-and-aft direction as an X-axis direction, a lateral direction as a Y-axis direction, and a vertical direction as a Z-axis direction. In the drawings, directions or sides indicated by arrows X, −X, Y, −Y, Z, and −Z are defined as "forward", "rearward", "rightward", "leftward", "upward", and "downward", or "front side", "rear side", "right side", "left side", "upper side", and "lower side", respectively.

In the drawings, a symbol represented by a dot in a circle means an arrow from back to front on the drawing sheet, and a symbol represented by a letter "x" in a circle means an arrow from front to back on the drawing sheet.

In the following description with reference to the drawings, illustrations other than members necessary to facilitate understanding are omitted as appropriate.

First Exemplary Embodiment

FIG. 1 illustrates an overall image forming apparatus of a first exemplary embodiment.

Figure 2:
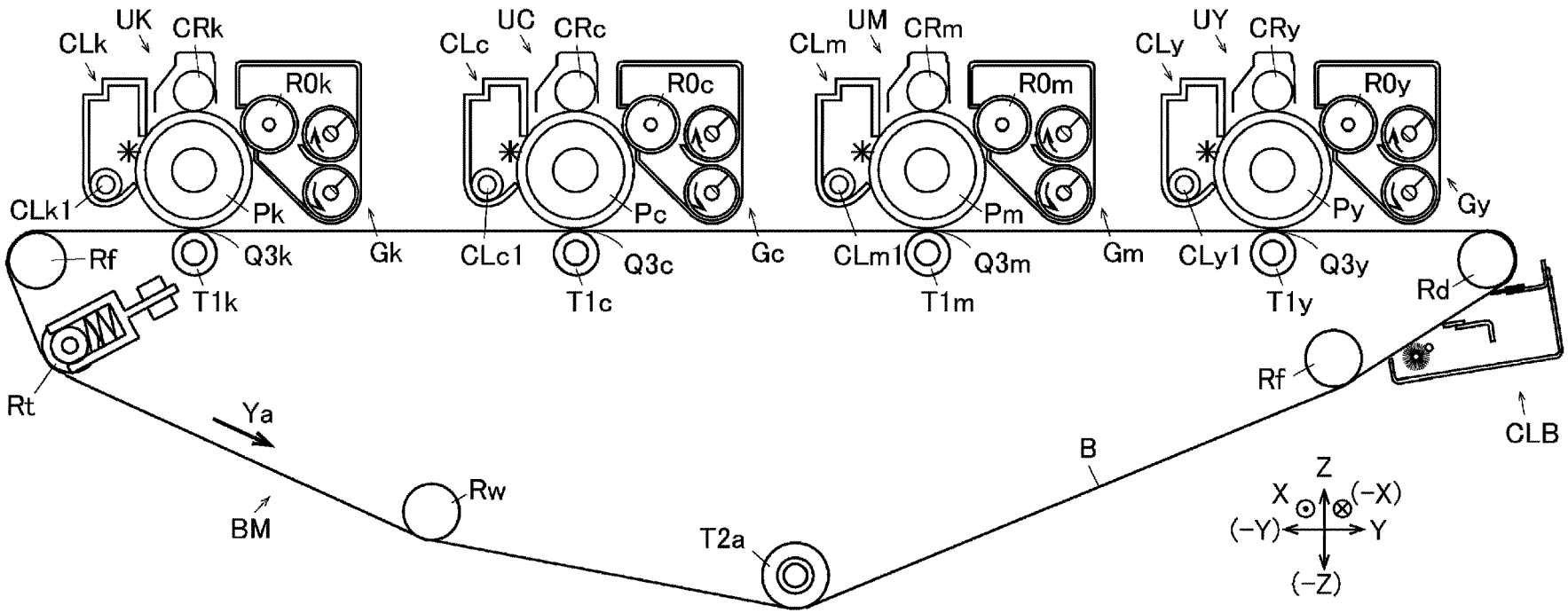
FIG. 2 is an enlarged view of a visible image forming device of the first exemplary embodiment.

FIG. 2 is an enlarged view of a visible image forming device of the first exemplary embodiment.

In FIG. 1, a copying machine U that is an example of an image forming apparatus includes a user interface UI that is an example of an operator, a scanner U1 that is an example of an image reading device, a feeder U2 that is an example of a medium feeding device, an image forming unit U3 that is an example of an image recording device, and a medium processing device U4.

(User Interface UI)

The user interface UI includes input buttons UIa to be used for starting copying and setting the number of copies. The user interface UI further includes a display UIb that displays information input by using the input buttons UIa and the status of the copying machine U.

(Feeder U2)

In FIG. 1, the feeder U2 includes a plurality of paper feed trays TR1, TR2, TR3, and TR4 that are examples of a medium container. The feeder U2 further includes a medium feed path SH1 along which recording paper S that is an example of an image recording medium is picked out from any one of the paper feed trays TR1 to TR4 and transported to the image forming unit U3.

(Image Forming Unit U3 and Medium Processing Device U4)

In FIG. 1, the image forming unit U3 includes an image recorder U3*a* that records an image on the recording paper S transported from the feeder U2 based on a document image read by the scanner U1.

In FIG. 1 and FIG. 2, a latent image forming device driving circuit D of the image forming unit U3 outputs, based on image information input from the scanner U1, driving signals to yellow (Y), magenta (M), cyan (C), and black (K) latent image forming devices ROSy, ROSm, ROSc, and ROSk at preset timings. Photoconductor drums Py, Pm, Pc, and Pk that are examples of an image carrier are disposed below the latent image forming devices ROSy to ROSk that are examples of a writer, respectively.

The surfaces of the rotating photoconductor drums Py to Pk are uniformly charged by charging rollers CRy, CRm, CRc, and CRk that are examples of a charger, respectively. Electrostatic latent images are formed on the charged surfaces of the photoconductor drums Py to Pk by laser beams Ly, Lm, Lc, and Lk that are examples of latent image writing light and output from the latent image forming devices ROSy to ROSk, respectively. The electrostatic latent images are developed into yellow (Y), magenta (M), cyan (C), and black (K) toner images that are examples of a visible image by developing devices Gy, Gm, Gc, and Gk that are examples of a developing unit, respectively.

In the developing devices Gy to Gk, developers consumed by development are supplied from toner cartridges Ky, Km, Kc, and Kk that are examples of a developer container, respectively. The toner cartridges Ky to Kk are removably mounted on a developer supply device U3*b*.

The toner images on the surfaces of the photoconductor drums Py to Pk are sequentially transferred and laid over one another in first transfer areas Q3*y*, Q3*m*, Q3*c*, and Q3*k* on an intermediate transfer belt B that is an example of an intermediate transferrer by first transfer rollers T1*y*, T1*m*, T1*c*, and T1*k* that are examples of a first transferrer, respectively. Thus, a color toner image that is an example of a multicolor visible image is formed on the intermediate transfer belt B. The color toner image is transported to a second transfer area Q4.

In a case of black image information alone, the black photoconductor drum Pk and the black developing device Gk are used to form a black toner image.

On the photoconductor drums Py to Pk after the first transfer, drum cleaners CLy, CLm, CLc, and CLk that are examples of an image carrier cleaner remove residues such as residual developers or paper dust on the surfaces, respectively.

In the first exemplary embodiment, the photoconductor drum Pk, the charging roller CRk, and the drum cleaner CLk are integrated into a black photoconductor unit UK that is an example of an image carrier unit. In the other colors (yellow, magenta, and cyan) as well, the photoconductor drums Py, Pm, and Pc, the charging rollers CRy, CRm, and CRc, and the drum cleaners CLy, CLm, and CLc constitute photoconductor units UY, UM, and UC, respectively.

The black photoconductor unit UK and the developing device Gk including a developing roller R0*k* that is an example of a developer carrier constitute a black image former UK+Gk. Similarly, the yellow, magenta, and cyan photoconductor units UY, UM, and UC and the developing devices Gy, Gm, and Gc including developing rollers R0*y*, R0*m*, and R0*c* constitute yellow, magenta, and cyan image formers UY+Gy, UM+Gm, and UC+Gc, respectively.

A belt module BM that is an example of the intermediate transferrer is disposed below the photoconductor drums Py to Pk. The belt module BM includes the intermediate transfer belt B that is an example of the image carrier, a driving roller Rd that is an example of an intermediate transferrer driver, a tension roller Rt that is an example of a tensile force applier, a walking roller Rw that is an example of a meandering preventer, a plurality of idler rollers Rf that are examples of a driven component, a backup roller T2*a* that is an example of a facing component, and the first transfer rollers T1*y* to T1*k*. The intermediate transfer belt B is supported while being rotatable in an arrow Ya direction.

In the first exemplary embodiment, the yellow, magenta, and cyan first transfer rollers T1*y*, T1*m*, and T1*c* are supported while being approachable to or separable from the photoconductor drums Py, Pm, and Pc, respectively. In multicolor printing, the yellow, magenta, and cyan first transfer rollers T1*y*, T1*m*, and T1*c* approach the photoconductor drums Py to Pc, respectively, to nip the intermediate transfer belt B at a predetermined contact pressure. In monochrome printing using black alone, the first transfer rollers T1*y*, T1*m*, and T1*c* are separated from the photoconductor drums Py to Pc, respectively.

A second transfer unit Ut is disposed below the backup roller T2*a*. The second transfer unit Ut includes a second transfer roller T2*b* that is an example of a second transferrer. The second transfer area Q4 is an area where the second transfer roller T2*b* is in contact with the intermediate transfer belt B. The backup roller T2*a* faces the second transfer roller T2*b* across the intermediate transfer belt B. A contact roller T2*c* that is an example of a power supplier is in contact with the backup roller T2*a*. A second transfer voltage having the same polarity as a toner charging polarity is applied to the contact roller T2*c*.

The backup roller T2*a*, the second transfer roller T2*b*, and the contact roller T2*c* constitute a second transferrer T2.

The second transfer unit Ut of the first exemplary embodiment is approachable to or separable from the intermediate transfer belt B. Depending on the type of the recording paper S in use, the second transfer unit Ut moves to change the contact pressure between the second transfer roller T2*b* and the intermediate transfer belt B. For example, in a case of thick paper, the contact pressure is reduced compared with a case of plain paper to reduce an impact when the leading edge of the thick paper enters the second transfer area Q4.

A medium transport path SH2 is disposed below the belt module BM. The recording paper S fed through the medium feed path SH1 of the feeder U2 is transported to registration rollers Rr that are an example of a transport timing adjuster by transport rollers Ra that are an example of a medium transporter. The registration rollers Rr transport the recording paper S downstream in synchronization with a timing when the toner image formed on the intermediate transfer belt B is transported to the second transfer area Q4. The recording paper S sent out by the registration rollers Rr is guided by a registration paper guide SGr and a pre-transfer paper guide SG1 and transported to the second transfer area Q4.

The toner image on the intermediate transfer belt B is transferred onto the recording paper S by the second transferrer T2 when passing through the second transfer area Q4. In the case of a color toner image, the toner images firstly transferred onto the surface of the intermediate transfer belt B and laid over one another are secondly transferred collectively onto the recording paper S.

The first transfer rollers T1*y* to T1*k*, the second transferrer T2, and the intermediate transfer belt B constitute a transfer device (transferrer) T1*y*–T1*k*+T2+B of the first exemplary embodiment.

The intermediate transfer belt B after the second transfer is cleaned by a belt cleaner CLB that is an example of an intermediate transferrer cleaner disposed on a downstream side of the second transfer area Q4. The belt cleaner CLB removes, from the intermediate transfer belt B, residues such as paper dust or developers that remain without being transferred in the second transfer area Q4.

The recording paper S onto which the toner image is transferred is guided by a post-transfer paper guide SG2 and sent to a belt transport device BH that is an example of the medium transporter. The belt transport device BH transports the recording paper S to a fixing device F.

The fixing device F includes a heating roller Fh that is an example of a heater, and a pressure roller Fp that is an example of a pressurizer. The recording paper S is transported to a fixing area Q5 where the heating roller Fh is in contact with the pressure roller Fp. The toner image on the recording paper S is fixed by being heated and pressurized by the fixing device F when passing through the fixing area Q5.

The image formers UY+Gy to UK+Gk, the transfer device T1*y*–T1*k*+T2+B, and the fixing device F constitute the image recorder U3*a* that is an example of an image former of the first exemplary embodiment.

A switching gate GT1 that is an example of a switcher is provided on a downstream side of the fixing device F. The switching gate GT1 selectively switches the recording paper S having passed through the fixing area Q5 into an output path SH3 toward the medium processing device U4 or into a reversing path SH4. The recording paper S transported to the output path SH3 is transported to a paper transport path SH5 of the medium processing device U4. A curl correction member U4*a* that is an example of a warp corrector is disposed on the paper transport path SH5. The curl correction member U4*a* corrects a warp, that is, a curl of the transported recording paper S. The recording paper S having undergone the curl correction is output, with its image-fixed side oriented upward, to an output tray TH1 that is an example of a medium outputter by output rollers Rh that are an example of a medium output member.

The recording paper S transported toward the reversing path SH4 of the image forming unit U3 by the switching gate GT1 is transported to the reversing path SH4 through a second gate GT2 that is an example of a switching member.

To output the recording paper S with its image-fixed side oriented downward, the transport direction of the recording paper S is reversed after the trailing edge of the recording paper S in the transport direction has passed through the second gate GT2. The second gate GT2 of the first exemplary embodiment is a thin-film elastic member. The second gate GT2 causes the recording paper S to temporarily pass when it is transported toward the reversing path SH4, and guides the recording paper S toward the transport paths SH3 and SH5 when the recording paper S is reversed, that is, switched back. The switched-back recording paper S is output to the output tray TH1 through the curl correction member U4*a* with its image-fixed side oriented downward.

A circulation path SH6 is connected to the reversing path SH4 of the image forming unit U3. A third gate GT3 that is an example of the switcher is disposed at the connecting portion. The downstream end of the reversing path SH4 is connected to a reversing path SH7 of the medium processing device U4.

The recording paper S transported to the reversing path SH4 through the switching gate GT1 is transported toward the reversing path SH7 of the medium processing device U4 by the third gate GT3. The third gate GT3 of the first exemplary embodiment is a thin-film elastic member similarly to the second gate GT2. The third gate GT3 causes the recording paper S to temporarily pass when it is transported along the reversing path SH4, and guides the recording paper S toward the circulation path SH6 when the recording paper S is switched back.

The recording paper S transported to the circulation path SH6 is sent again to the second transfer area Q4 through the medium transport path SH2, and printing is performed on the second side.

The elements SH1 to SH7 constitute a paper transport path SH. The elements SH, Ra, Rr, Rh, SGr, SG1, SG2, BH, and GT1 to GT3 constitute a paper transport device SU of the first exemplary embodiment.

(Medium Transport Device)

Figure 3:
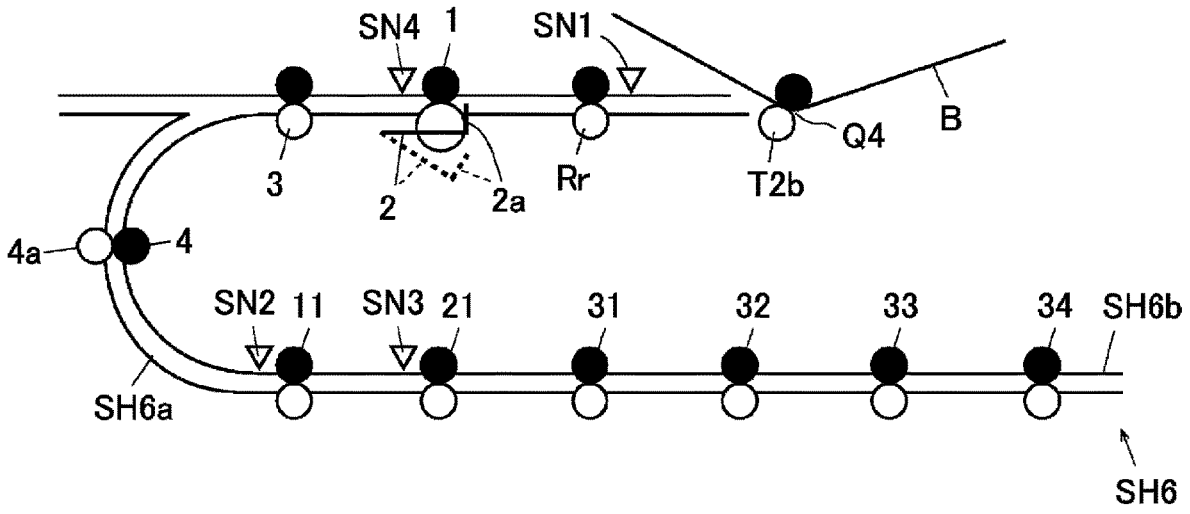
FIG. 3 illustrates a medium transport device of the first exemplary embodiment.

FIG. 3 illustrates a medium transport device of the first exemplary embodiment.

In FIG. 3, the registration rollers Rr of the first exemplary embodiment rotate in response to driving transmission from a motor (not illustrated) to send the recording paper S toward the second transfer area Q4, and are movable along an axial direction of each rotation shaft. Thus, the registration rollers Rr of the first exemplary embodiment function as downstream side correction rollers that are an example of a positional corrector and an example of a first positional correction member, in addition to the function of adjusting the timing to send the recording paper S toward the second transfer area Q4.

An abutment gate 2 that is an example of a first inclination corrector is disposed at a position of first transport rollers 1 on an upstream side of the registration rollers Rr. The abutment gate 2 is movable between an abutment position where an abutment portion 2*a* enters the medium transport path SH2 (see the solid line in FIG. 3) and a retraction position where the abutment portion 2*a* is retracted from the medium transport path SH2 (see the broken line in FIG. 3). At the abutment position of the abutment gate 2, the leading edge of the recording paper S abuts against the abutment gate 2 to correct an inclination, that is, a skew of the recording paper S.

A junction path SH6*a* of the circulation path SH6 on a downstream side in the transport direction is joined to the medium transport path SH2. The junction path SH6*a* of the first exemplary embodiment is curved into an arc from the bottom to the top. An upstream portion SH6*b* extending straight in a horizontal direction (in a planar or flat shape) is connected to an upstream side of the arcuate junction path SH6*a*.

Along the junction path SH6*a*, second transport rollers 3 that are an example of a transporter are disposed on an upstream side of the first transport rollers 1 in the transport direction. Third transport rollers 4 that are an example of the transporter are disposed on an upstream side of the second transport rollers 3. In each of the first transport rollers 1 to the third transport rollers 4 of the first exemplary embodiment, the paired rollers facing each other across the recording paper S are movable between a non-nipping position where the rollers are separated from each other to cancel the nip of the recording paper S and a transport position where the rollers are in contact with each other to nip and transport the recording paper. That is, the recording paper S is nipped by each of the transport rollers 1 to 4 at the transport position, and is not nipped at the non-nipping position. In each of the transport rollers 1 to 4 of the first exemplary embodiment, one of the paired rollers is a driving side and the other is a driven side. The driving roller does not move and the driven roller moves. In FIG. 3, the driving side is represented by a solid circle and the driven side is represented by a blank circle. In the first exemplary embodiment, the separable roller is disposed on a lower side in the gravity direction. That is, the recording paper S sagging by gravity comes into contact with the non-rotatable driven roller and an inappropriate transport force is not applied to the recording paper S.

In the circulation path SH6 of FIG. 3, upstream side correction rollers 11 that are an example of the positional corrector and an example of a second positional correction member are disposed on an upstream side of the third transport rollers 4. Similarly to the registration rollers Rr, the upstream side correction rollers 11 are movable along an axial direction of each rotation shaft. In the first exemplary embodiment, the upstream side correction rollers 11 are movable between the transport position and the non-nipping position similarly to the transport rollers 1 to 4.

Figure 4:
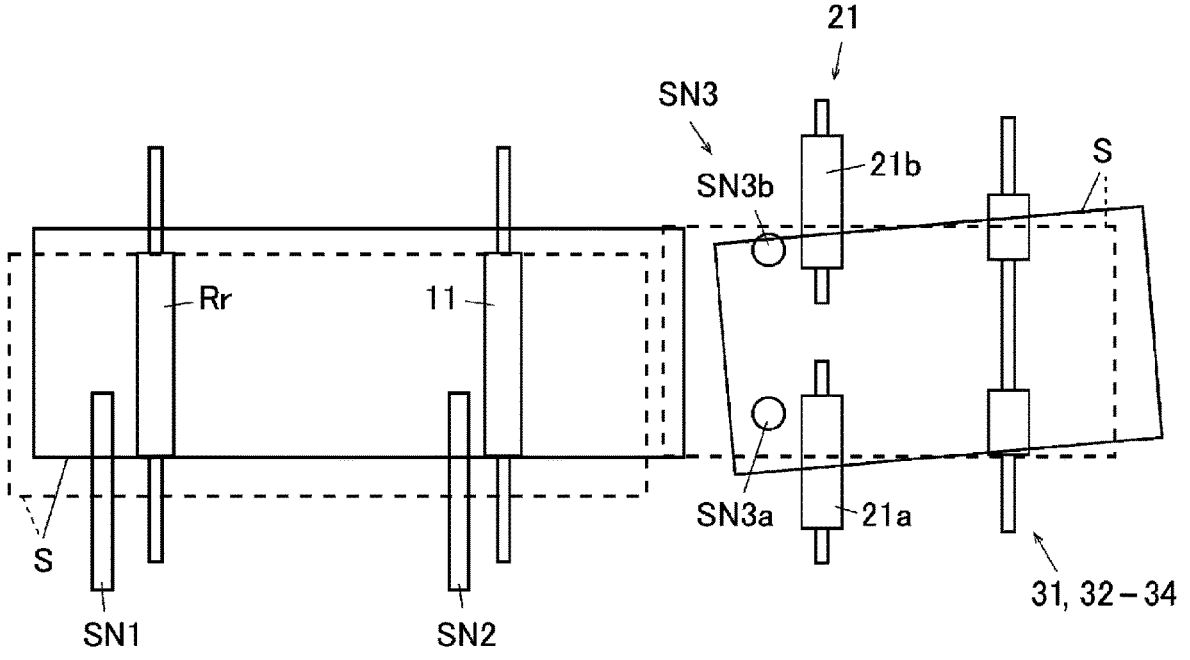
FIG. 4 illustrates a positional relationship between a positional corrector and an inclination corrector of the medium transport device of the first exemplary embodiment.

FIG. 4 illustrates a positional relationship between the positional corrector and the inclination corrector in the medium transport device of the first exemplary embodiment.

In FIG. 4, illustration is omitted for members not related to the positional corrector and the inclination corrector.

In FIG. 3 and FIG. 4, skew correction rollers 21 that are an example of a second inclination corrector are disposed in the upstream portion SH6*b* on an upstream side of the upstream side correction rollers 11.

In FIG. 4, the skew correction rollers 21 are disposed in pairs with a distance therebetween in an axial direction of each rotation shaft, that is, a width direction of the recording paper S. That is, the skew correction rollers 21 of the first exemplary embodiment include left rollers 21*a* that are an example of a first inclination correction member disposed on one side in the width direction, and right rollers 21*b* that are an example of a second inclination correction member disposed on the other side in the width direction. The left rollers 21*a* and the right rollers 21*b* of the first exemplary embodiment are independently controllable in terms of driving transmission from a motor, rotational speed, driving and stopping, and speed change timing.

In FIG. 3, the skew correction rollers 21 of the first exemplary embodiment are movable between the transport position and the non-nipping position similarly to the transport rollers 1 to 4 and the upstream side correction rollers 11. A plurality of transport rollers 31 to 34 that are examples of the medium transporter are disposed on an upstream side of the skew correction rollers 21. The transport rollers 31 to 34 are movable between the transport position and the non-nipping position similarly to the transport rollers 1 to 4.

In the copying machine U of the first exemplary embodiment of FIG. 3 and FIG. 4, a first side detection sensor SN1 that is an example of a position detector is disposed on a downstream side of the registration rollers Rr on the medium transport path SH2. In FIG. 4, the first side detection sensor SN1 detects one edge, that is, one side of the recording paper S in the width direction. The first side detection sensor SN1 of the first exemplary embodiment is, but not limited to, a so-called line sensor including detectors arranged in line. Any known detector such as a contact image sensor (CIS) may be employed to detect the edge of the recording paper S.

A second side detection sensor SN2 that is an example of the position detector is disposed on a downstream side of the upstream side correction rollers 11. The second side detection sensor SN2 is similar to the side detection sensor SN1 and is configured to detect one edge of the recording paper in the width direction.

In FIG. 3 and FIG. 4, skew detection sensors SN3 that are an example of an inclination detector are disposed on a downstream side of the skew correction rollers 21. In FIG. 4, the skew detection sensors SN3 include a left sensor SN3*a* associated with the left rollers 21*a*, and a right sensor SN3*b* associated with the right rollers 21*b*. The inclination, that is, the skew of the recording paper S in the transport direction may be derived based on the transport speeds of the skew correction rollers 21 and a time difference from detection of the leading edge of the recording paper S in the transport direction by one of the sensors SN3*a* and SN3*b* to detection of the leading edge by the other one of the sensors SN3*a* and SN3*b*.

A paper sensor SN4 that detects the presence or absence of the recording paper S is disposed near the first transport rollers 1.

The rollers Rr and 1 to 34 and the sensors SN1 to SN4 constitute the medium transport device of the first exemplary embodiment.

(Controller of First Exemplary Embodiment)

Figure 5:
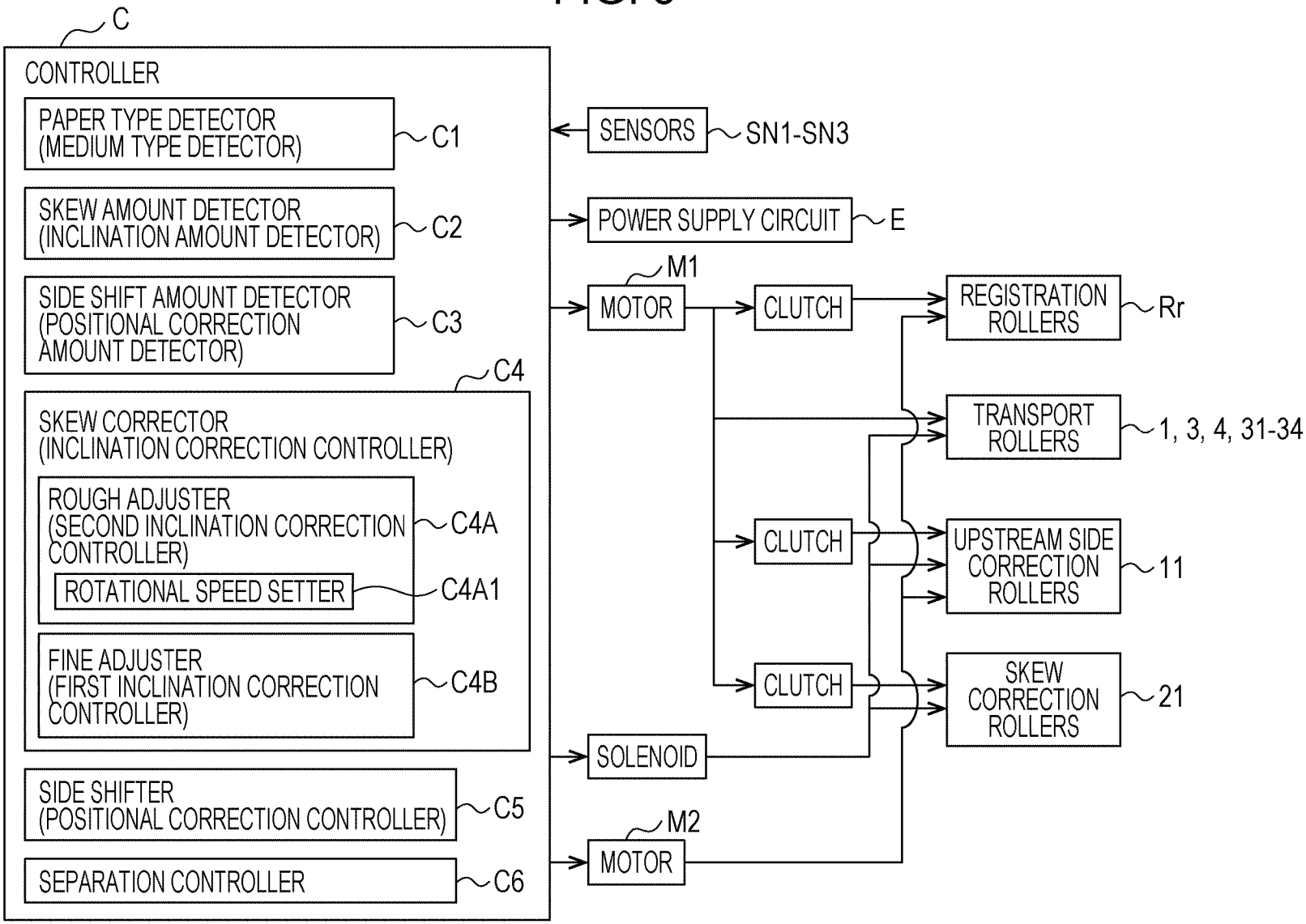
FIG. 5 illustrates a controller of the first exemplary embodiment.

FIG. 5 illustrates a controller of the first exemplary embodiment.

In FIG. 5, a controller C of the copying machine U includes an input/output interface I/O for inputting signals from and outputting signals to the outside. The controller C includes a read-only memory (ROM) that stores programs and information for processes. The controller C further includes a random-access memory (RAM) that temporarily stores data. The controller C further includes a central processing unit (CPU) that performs processes based on the programs stored in the ROM or the like. The controller C of the first exemplary embodiment is a small-size information processing device, that is, a microcomputer. The controller C may implement various functions by executing the programs stored in the ROM or the like.

The controller C of the first exemplary embodiment receives signals from signal output elements, and controls control target elements by outputting signals thereto.

(Signal Output Elements)

The controller C receives signals from the signal output elements such as sensors (not illustrated).

(Control Target Elements)

The controller C outputs signals to the control target elements such as a power supply circuit E, a motor M1 that drives the registration rollers Rr and the transport rollers 1 to 34, a solenoid that is an example of a mover that moves the rollers 1 to 34 between the transport position and the non-nipping position, and a motor M2 that moves the registration rollers Rr and the upstream side correction rollers 11 in the width direction of the recording paper S.

(Functions of Controller C)

The controller C of the first exemplary embodiment includes the following functional elements (functional modules or program modules) C1 to C6.

A paper type detector C1 that is an example of a medium type detector detects, as examples of the type of the recording paper S, a paper type such as plain paper, thick paper, or thin paper and the size, in particular, the length of the recording paper S along the transport direction. If a user inputs the type of the recording paper (paper type and size) via the UI, the paper type detector C1 detects information on the input type as the type of the recording paper S. As for the size of the recording paper, if long paper is used and the user does not input its paper size, the length of the recording paper S may be detected based on a transport speed of the recording paper S and detection results from sensors disposed at various positions in the transport paths SH1 to SH7 to detect passage of the recording paper S, that is, times when the recording paper S has passed by the sensors.

A skew amount detector C2 that is an example of an inclination amount detector detects a skew amount of the recording paper S (inclination amount or angle relative to the transport or width direction) based on detection results from the skew detection sensors SN3. For example, the skew amount detector C2 of the first exemplary embodiment detects the skew amount by calculating a length of deviation in the paper transport direction relative to a unit length in the paper width direction based on the transport speed of the recording paper S and a difference in timings when the left sensor SN3*a* and the right sensor SN3*b* have detected the leading edge of the recording paper S.

A side shift amount detector C3 that is an example of a positional correction amount detector detects a positional correction amount, that is, a side shift amount in the width direction of the recording paper S based on detection results from the side detection sensors SN1 and SN2. The side shift amount detector C3 of the first exemplary embodiment detects a side shift amount at the leading edge of the recording paper S based on the detection result from the first side detection sensor SN1. If the side edge of the recording paper S is detected by the first side detection sensor SN1 and the trailing edge of the recording paper S is also detected by the second side detection sensor SN2, that is, if the recording paper S is longer than the length between the registration rollers Rr and the upstream side correction rollers 11, the side shift amount detector C3 detects a side shift amount at the trailing edge of the recording paper S based on the detection result from the second side detection sensor SN2.

Figure 6A:
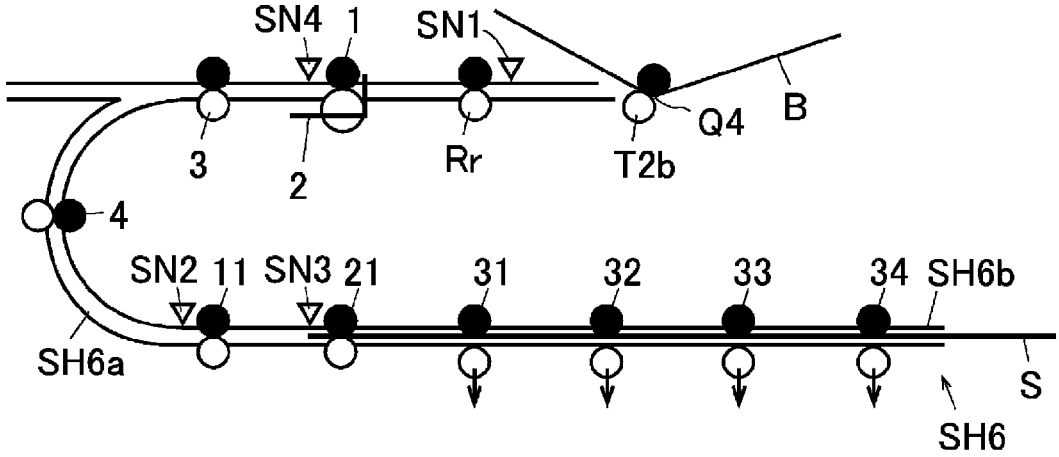
FIG. 6A illustrates an operation of the first exemplary embodiment during skew amount detection.
Figure 6B:
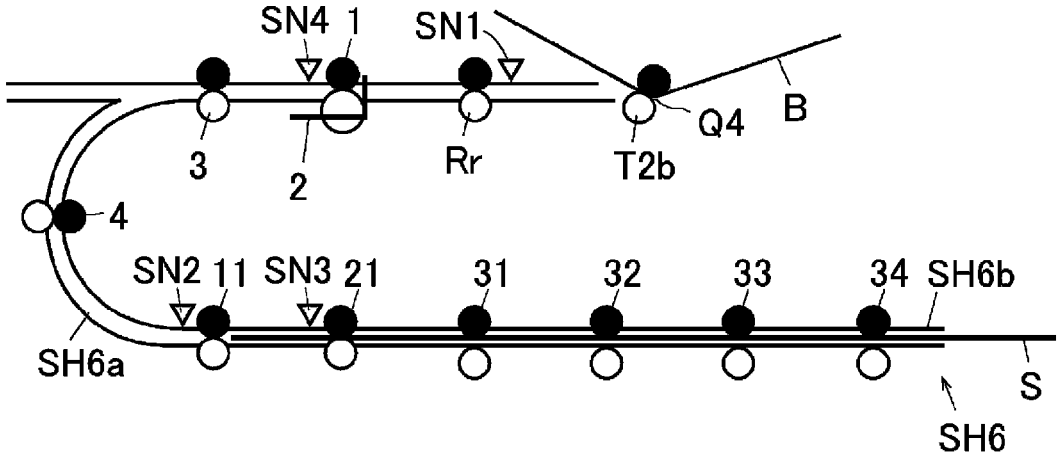
FIG. 6B illustrates an operation of the first exemplary embodiment during rough adjustment.
Figure 6C:
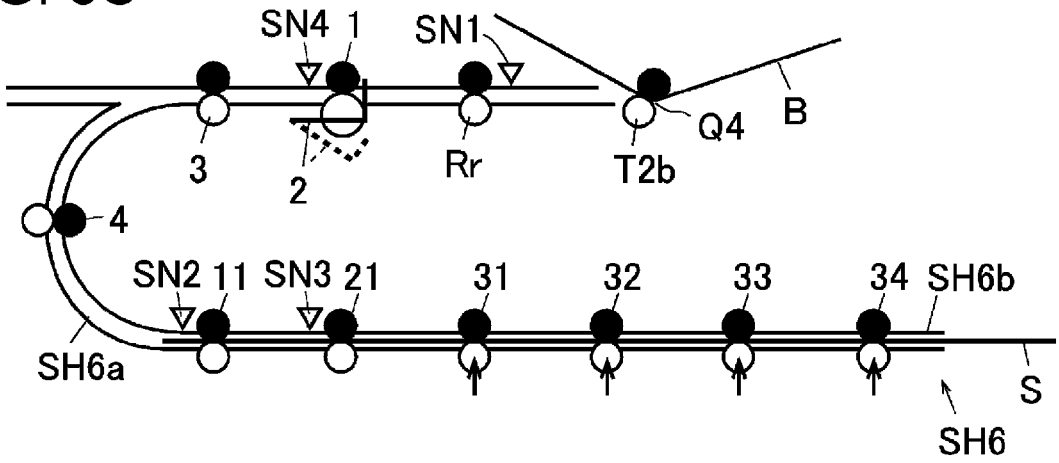
FIG. 6C illustrates an operation of the first exemplary embodiment after the rough adjustment.
Figure 6D:
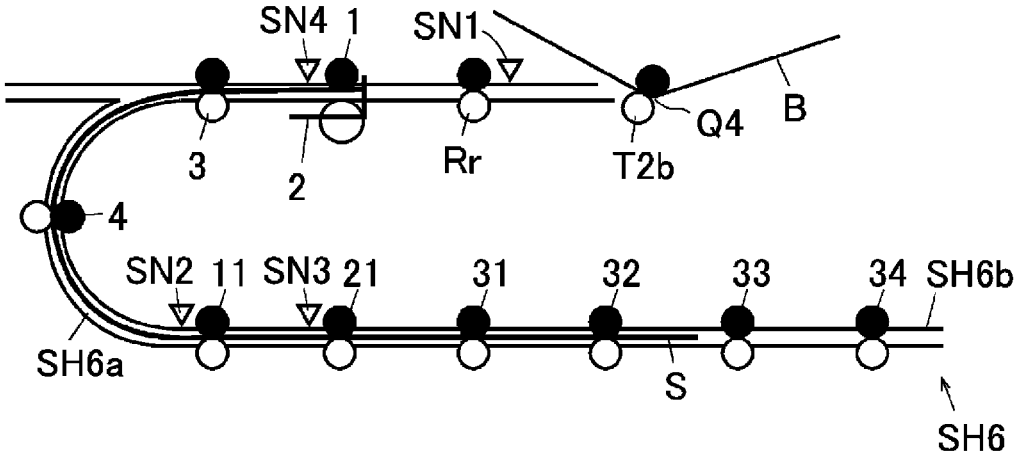
FIG. 6D illustrates an operation of the first exemplary embodiment during fine adjustment.
Figure 6E:
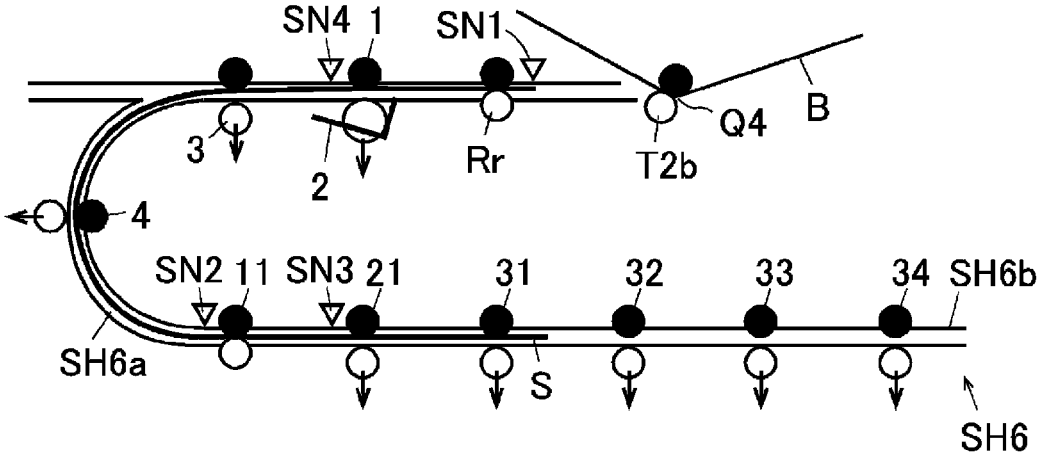
FIG. 6E illustrates an operation of the first exemplary embodiment during side shift correction.

FIG. 6A illustrates an operation of the first exemplary embodiment during skew amount detection. FIG. 6B illustrates an operation of the first exemplary embodiment during rough adjustment. FIG. 6C illustrates an operation of the first exemplary embodiment after the rough adjustment. FIG. 6D illustrates an operation of the first exemplary embodiment during fine adjustment. FIG. 6E illustrates an operation of the first exemplary embodiment during side shift correction.

A skew corrector C4 that is an example of an inclination correction controller includes a rough adjuster C4A and a fine adjuster C4B, and corrects a skew of the recording paper S.

The rough adjuster C4A that is an example of a second inclination correction controller includes a rotational speed setter C4A1, and corrects the skew of the recording paper S. In FIG. 6A and FIG. 6B, the rough adjuster C4A of the first exemplary embodiment controls the skew correction rollers 21 to correct the skew of the recording paper S, thereby performing the rough adjustment that is an example of second inclination correction.

Based on the skew amount detected by the skew amount detector C2, the rotational speed setter C4A1 sets rotational speeds of the skew correction rollers 21 to reduce the skew amount. For example, if the recording paper S has such an inclination that the left side in the paper width direction advances compared with the right side, the rotational speed setter C4A1 of the first exemplary embodiment reduces the skew amount by setting the rotational speed of the left rollers 21*a* to be lower than the rotational speed of the right rollers 21*b*. The speed difference between the left rollers 21*a* and the right rollers 21*b* may be set based on the detected skew amount. The skew correction may be performed not only by setting the rotational speeds of the rollers 21*a* and 21*b* based on the skew amount, but also by, for example, providing two levels that are "high" and "low" for the rotational speeds and adjusting a timing to switch the rotational speed on the advancing side from "high" to "low", that is, a period to transport the advancing side at a low speed based on the skew amount.

The fine adjuster C4B that is an example of a first inclination correction controller corrects the skew of the recording paper S on a downstream side of the recording paper S having undergone the skew correction at the skew correction rollers 21. In FIG. 6D, the fine adjuster C4B of the first exemplary embodiment corrects the skew of the recording paper S by bringing the leading edge of the recording paper S into abutment against the abutment gate 2. That is, the fine adjustment that is an example of first inclination correction is performed by correcting the skew of the recording paper S using the abutment gate 2. In the first exemplary embodiment, the abutment gate 2 is controlled to move to the abutment position when the recording paper S is transported along the circulation path SH6. The abutment gate 2 is controlled to move to the retraction position when a predetermined period (abutment period) has elapsed since the leading edge of the recording paper S reached the abutment gate 2 based on a result of detection of the leading edge of the recording paper S by the paper sensor SN4.

A side shifter C5 that is an example of a positional correction controller corrects the positions of the edges of the recording paper S in the width direction by moving the registration rollers Rr and the upstream side correction rollers 11 in the axial direction based on the side shift amount detected by the side shift amount detector C3. In FIG. 6E, the side shifter C5 of the first exemplary embodiment corrects the positions by causing the registration rollers Rr to move (side-shift) the recording paper S in the width direction if the length of the recording paper S is smaller than the length between the registration rollers Rr and the upstream side correction rollers 11. The side shifter C5 corrects the positions by causing the registration rollers Rr and the upstream side correction rollers 11 to move (side-shift) the recording paper S in the width direction if the length of the recording paper S is larger than the length between the registration rollers Rr and the upstream side correction rollers 11.

A separation controller C6 controls each of the rollers 1 to 34 to move to the non-nipping position or the transport position during the skew correction or side shift operation.

To perform the skew correction (rough adjustment) using the skew correction rollers 21 in FIG. 6A and FIG. 6B, the separation controller C6 of the first exemplary embodiment moves the skew correction rollers 21 to the transport position and moves the transport rollers 31 to 34 on the upstream side of the skew correction rollers 21 to the non-nipping position. In the first exemplary embodiment, all the transport rollers 31 to 34 are not moved to the non-nipping position, but any of the transport rollers 31 to 34 in contact with the recording paper S are moved to the non-nipping position based on the length of the recording paper S. When the length of the recording paper S is small, only the transport rollers 31 may be moved to the non-nipping position. When the length of the recording paper S is large, all the transport rollers 31 to 34 may be moved to the non-nipping position. Thus, when the skew correction rollers 21 perform the skew correction, only the skew correction rollers 21 are controlled to come into contact with the recording paper S, and the other rollers 31 to 34 are controlled not to come into contact with the recording paper S. At this time, the transport rollers 1 to 4 and 11 on the downstream side of the skew correction rollers 21 are moved to the transport position. The rough adjustment is finished at a predetermined timing before the leading edge of the recording paper S reaches the upstream side correction rollers 11.

In FIG. 6C, when the rough adjustment is finished, the transport rollers 31 to 34 on the upstream side of the skew correction rollers 21 are moved to the transport position. In FIG. 6D, the skew correction (fine adjustment) using the abutment gate 2 is performed next. Although the fine adjustment is performed with the rollers 1 to 34 moved to the transport position in the first exemplary embodiment, the fine adjustment may be performed with the rollers 3 to 34 moved to the non-nipping position, excluding the first transport rollers 1 near the abutment gate 2 on the upstream side.

In FIG. 6E, when the fine adjustment is finished and the side shift operation is started with the leading edge of the recording paper S nipped by the registration rollers Rr, the rollers other than the registration rollers Rr and the upstream side correction rollers 11 are moved to the non-nipping position. During the side shift operation, the recording paper S is nipped by the registration rollers Rr and the upstream side correction rollers 11.

After the position of the recording paper S is corrected by the side shift operation, the recording paper S is transported by the registration rollers Rr and the upstream side correction rollers 11, or with the rollers at the non-nipping position partially moved to the transport position. After the transport of the recording paper S is completed, all the rollers 1 to 4, 21, and 31 to 34 at the non-nipping position are moved to the transport position for the next paper.

(Flowchart of First Exemplary Embodiment)

Referring to a flowchart, description is made about a flow of control in the copying machine U of the first exemplary embodiment.

Figure 7:
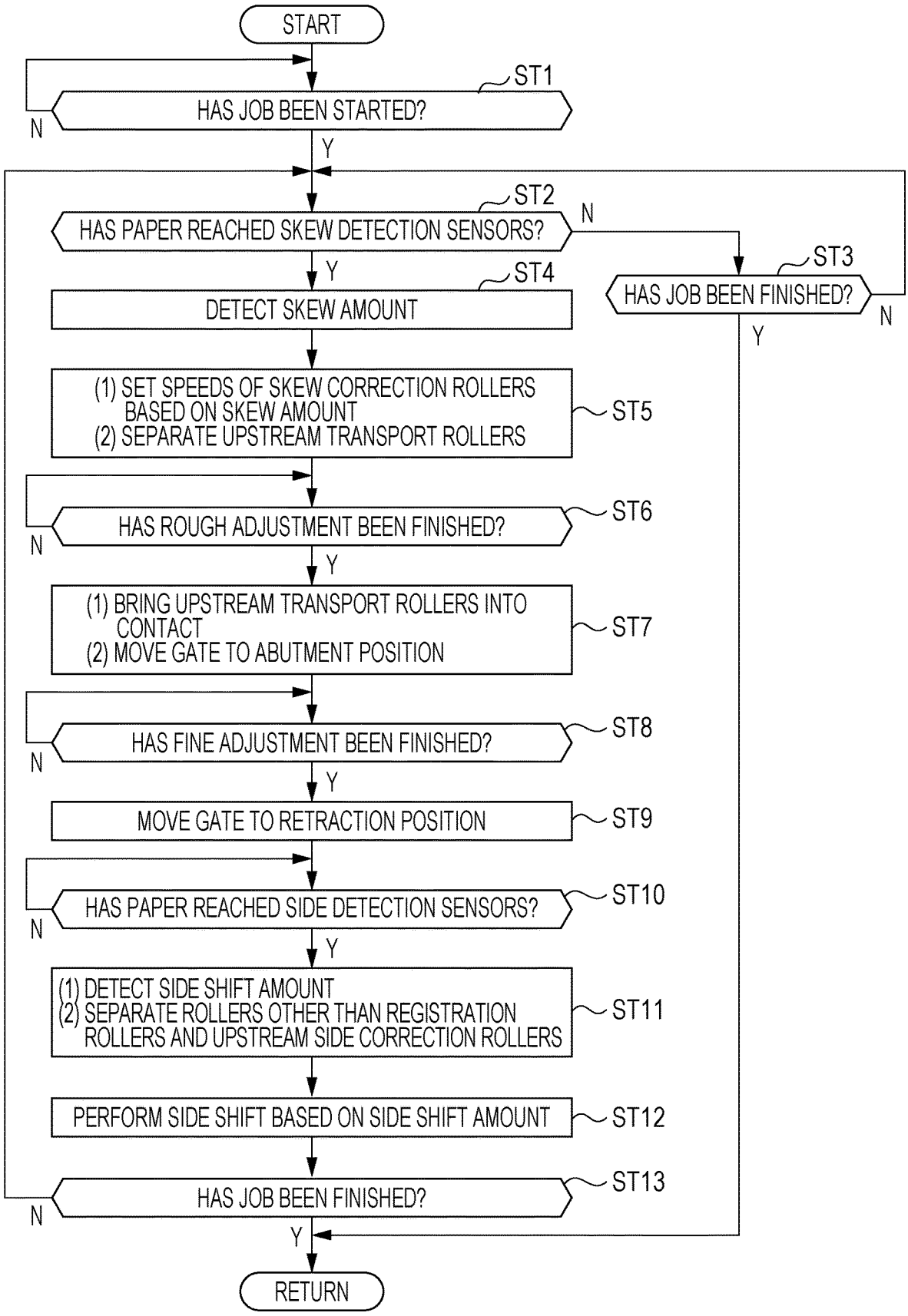
FIG. 7 is a flowchart of skew correction and side shift operations of the first exemplary embodiment.

FIG. 7 is a flowchart of the skew correction and side shift operations of the first exemplary embodiment.

A process of each step ST in the flowchart of FIG. 7 is performed based on a program stored in the controller C. The process is performed parallel to various other processes in the copying machine U.

The flow of FIG. 7 is started when the copying machine U is powered ON.

In ST1 of FIG. 7, determination is made as to whether an image forming job has been started. If the determination result is "YES" (Y), the process proceeds to ST2. If the determination result is "NO" (N), ST1 is repeated.

In ST2, determination is made as to whether the recording paper S has reached the skew detection sensors SN3. If the determination result is "YES" (Y), the process proceeds to ST4. If the determination result is "NO" (N), the process proceeds to ST3.

In ST3, determination is made as to whether the job has been finished. If the determination result is "YES" (Y), the process returns to ST1. If the determination result is "NO" (N), the process returns to ST2.

In ST4, a skew amount is detected based on detection results from the skew detection sensors SN3. Then, the process proceeds to ST5.

In ST5, the following processes (1) and (2) are executed, and the process proceeds to ST6.

(1) The speeds of the skew correction rollers 21 are set based on the skew amount.

(2) The transport rollers 31 to 34 on the upstream side are moved to the non-nipping position based on the length of the recording paper S.

In ST6, determination is made as to whether the rough adjustment using the skew correction rollers 21 has been finished. If the determination result is "YES" (Y), the process proceeds to ST7. If the determination result is "NO" (N), ST6 is repeated.

In ST7, the following processes (1) and (2) are executed, and the process proceeds to ST8.

(1) The transport rollers 31 to 34 at the non-nipping position are moved to the transport position.

(2) The abutment gate 2 is moved to the abutment position.

In ST8, determination is made as to whether the fine adjustment using the abutment gate 2 has been finished. That is, determination is made as to whether a predetermined period has elapsed since the abutment gate 2 was moved to the abutment position and the leading edge of the recording paper S has abutted against the abutment gate 2 to finish the skew correction. Then, the process proceeds to ST9.

In ST9, the abutment gate 2 is moved to the retraction position. Then, the process proceeds to ST10.

In ST10, determination is made as to whether the recording paper S has reached the side detection sensors. If the determination result is "YES" (Y), the process proceeds to ST11. If the determination result is "NO" (N), ST10 is repeated.

In ST11, the following processes (1) and (2) are executed, and the process proceeds to ST12.

(1) A side shift amount is detected based on detection results from the side detection sensors SN1 and SN2.

(2) The rollers 1 to 4, 21, and 31 to 34 other than the registration rollers Rr and the upstream side correction rollers 11 are moved to the non-nipping position.

In ST12, the positions of the side edges of the recording paper S are corrected by moving (side-shifting) the registration rollers Rr and the upstream side correction rollers 11 in the axial direction based on the side shift amount. Then, the process proceeds to ST13.

In ST13, determination is made as to whether the job has been finished. If the determination result is "YES" (Y), the process returns to ST1. If the determination result is "NO" (N), the process returns to ST2.

(Operations of First Exemplary Embodiment)

During duplex printing in the copying machine U of the first exemplary embodiment having the structure described above, the recording paper S having an image recorded on the first side is reversed by being transported along the circulation path SH6. The transported recording paper S is sent to the second transfer area Q4 while being corrected in terms of an inclination (skew) and side edge misregistration that have occurred during the transport. Printing on the second side is performed with reduced misalignment of images on both sides.

In the first exemplary embodiment, the skew correction is first performed by the skew correction rollers 21 on the upstream side along the paper transport direction in the circulation path SH6. Then, the skew correction is performed by the abutment gate 2 on the downstream side. Then, the side edge misregistration of the recording paper S is corrected (side shift correction is performed) after the skew correction.

In the structure as in Japanese Unexamined Patent Application Publication No. 2008-1473 in which the skew correction rollers (21, 22) perform the skew correction, the skew is corrected while transporting the recording paper S. When the recording paper S has reached next rollers, the skew correction is not performed any more. Therefore, there is an upper limit on the correctable skew amount, and the skew correction may be insufficient in a case of a large skew amount.

The skew correction may be performed by bringing the recording paper S into abutment against a gate instead of using the skew correction rollers (21, 22). In the correction by abutment, the skew at the leading edge is corrected but the correction may be insufficient for a skew at the trailing edge in the transport direction due to transport after the correction. In particular, the skew correction may become difficult as the length of the recording paper S increases.

In the first exemplary embodiment, the skew correction is performed by the skew correction rollers 21 on the upstream side, and then performed also by the abutment gate 2 on the downstream side. In other words, the skew correction is performed roughly by the skew correction rollers 21 on the upstream side (rough adjustment), and the final skew correction is performed by the abutment gate 2 on the downstream side (fine adjustment).

In the first exemplary embodiment, the skew correction rollers 21 on the upstream side correct the skew by individually controlling the driving of the rollers 21*a* and 21*b* on both sides in the width direction. Although an abutment gate may be provided in place of the skew correction rollers 21, the transport of the recording paper S is temporarily stopped by the abutment gate. Therefore, a problem arises in that the entire transport of the recording paper S is delayed due to the abutment gates provided in two stages. In the first exemplary embodiment, the skew correction rollers 21 perform the skew correction while transporting the recording paper S downstream.

In the first exemplary embodiment, the skew is corrected by causing a difference in the transport between one edge and the other edge in the width direction by varying the rotational speeds of the rollers 21*a* and 21*b* based on the skew amount. The timing to switch the rotational speed from "high" to "low" may be adjusted based on the skew amount.

In the first exemplary embodiment, during the skew correction by the skew correction rollers 21, the transport rollers 31 to 34 on the upstream side are moved to the non-nipping position. If the recording paper S is nipped by the transport rollers 31 to 34 during the correction by the skew correction rollers 21, the skew correction may be hindered and the recording paper S may be creased or ripped by distortion. In the first exemplary embodiment, during the skew correction by the skew correction rollers 21, the recording paper S is nipped by the skew correction rollers 21 alone. In particular, in the first exemplary embodiment, any of the transport rollers 31 to 34 to be moved to the non-nipping position are selected based on the length of the recording paper S.

In the first exemplary embodiment, the skew correction rollers 21, the transport rollers 31 to 34, and the upstream side correction rollers 11 are disposed in the flat upstream portion SH6*b* of the circulation path SH6. Therefore, the skew correction is performed by the skew correction rollers 21 with the recording paper S kept in a flat posture. In a case of skew correction performed at a position where the recording paper S is in a curved or wavy posture, the curved recording paper S may hinder the skew correction by coming into contact with or interfering with the wall in the transport path, thereby causing insufficiency of correction.

In the first exemplary embodiment, the abutment gate 2 is used in the fine adjustment. During the fine adjustment, the rollers other than the first transport rollers 1 are moved to the non-nipping position. When separating the rollers other than the first transport rollers 1, any of the transport rollers 3 to 34 to be separated are selected based on the length of the recording paper S.

In the first exemplary embodiment, the side shift correction is performed by the registration rollers Rr and the upstream side correction rollers 11. In particular, in the first exemplary embodiment, the junction path SH6*a* of the circulation path SH6 has an arc shape, and the registration rollers Rr and the upstream side correction rollers 11 are disposed on the downstream side and the upstream side of the junction path SH6*a*. If the side shift correction is performed with the recording paper S entering the arcuate junction path SH6*a*, the recording paper S may be caught and the side shift correction may be insufficient in a case of long recording paper S. In the first exemplary embodiment, the side shift correction is performed by the registration rollers Rr and the upstream side correction rollers 11 disposed across the junction path SH6*a*.

In the first exemplary embodiment, during the side shift correction, the rollers 1 to 4 and 21 to 34 other than the registration rollers Rr and the upstream side correction rollers 11 are moved to the non-nipping position. In particular, during the side shift correction, an outer roller 4*a* disposed on an outer side of the arc in the third transport rollers 4 disposed midway along the arcuate junction path SH6*a* is moved to the non-nipping position.

In the first exemplary embodiment, the upstream side correction rollers 11 are disposed on an immediately downstream side of the skew correction rollers 21. In a structure in which one or more transport members are disposed between the upstream side correction rollers 11 and the skew correction rollers 21, the length of the circulation path SH6 increases and the size of the entire device increases. Further, the transport distance increases and a skew may newly occur.

(Modifications)

Modifications (H01) to (H07) of the exemplary embodiment of the present disclosure are described below.

(H01) In the exemplary embodiment, the copying machine U is provided as the example of the image forming apparatus. The image forming apparatus may be a FAX machine or a multifunction peripheral having a plurality of functions of a FAX machine, a printer, and a copying machine. The image forming apparatus is not limited to the multicolor-development image forming apparatus, and may be a monochrome image forming apparatus. Further, any electronic or mechanical apparatus using motors and gears may be an alternative to the image forming apparatus.

(H02) In the exemplary embodiment, the skew correction is performed on all types of recording paper S. For example, the rough adjustment or the fine adjustment may be skipped in a case of thin paper or thick paper that is relatively unlikely to cause a skew, and both the rough adjustment and the fine adjustment may be performed only in a case of plain paper.

(H03) In the exemplary embodiment, the skew correction rollers 21 are used in the rough adjustment, and the abutment gate 2 is used in the fine adjustment. The skew correction rollers may be used both in the rough adjustment and in the fine adjustment. The abutment gates may be used both in the rough adjustment and in the fine adjustment. The abutment gate may be used in the rough adjustment, and the skew correction rollers may be used in the fine adjustment.

Although the skew correction is performed twice, that is, the rough adjustment and the fine adjustment are performed, the skew correction may be performed three times or more.

(H04) In the exemplary embodiment, the upstream side correction rollers 11 are also used as appropriate during the side shift correction. For example, the side shift correction may be performed by the registration rollers Rr alone. For example, the side shift correction may be performed by the registration rollers Rr and the upstream side correction rollers 11 in a case of a type of paper such as thick paper that is easily caught on the arcuate junction path SH6*a*, that is, a type of paper having a large resistance (transport resistance) during the side shift, and the side shift correction may be performed by the registration rollers Rr alone in a case of plain paper or thin paper having a small resistance during the side shift. If the side shift correction is performed by the registration rollers Rr alone, the upstream side correction rollers 11 are moved to the non-nipping position.

(H05) In the exemplary embodiment, when the rollers are moved to the non-nipping position, the rollers are completely separated from the recording paper S, that is, the contact pressure with the paper is kept zero. Alternatively, the recording paper S and the rollers may slip on each other in such a manner that the rollers are not completely separated from the recording paper and the contact pressure is kept lower than that during the transport of the recording paper.

(H06) In the exemplary embodiment, the two side detection sensors are provided. For example, only the side detection sensor SN1 on the downstream side may suffice. The positions may be corrected by calculating the side shift amount based on the detection result from the side detection sensor SN1 and side-shifting the registration rollers Rr and the upstream side correction rollers 11 by the same amount.

(H07) In the exemplary embodiment, each roller may freely be moved in the axial direction (thrust-free structure: the roller returns to the central position by springs at both ends of the shaft) without being moved in the radial direction to the non-nipping position.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium transport device comprising:

positional correction rollers configured to transport a medium and correct a position of the medium in a width direction of the medium by moving the medium in the width direction; and inclination correction rollers configured to transport the medium and correct an inclination of the medium relative to a transport direction of the medium on an upstream side of the positional correction rollers in the transport direction, the inclination correction rollers being disposed at a position where the medium is transported in a flat posture, wherein the positional correction rollers comprise:

first positional correction rollers configured to nip and transport the medium; and second positional correction rollers disposed on an upstream side of the first positional correction rollers across an arcuate transport path for the medium and configured to nip and transport the medium, and the positional correction rollers are configured to correct the position of the medium in the width direction by moving the first positional correction rollers and the second positional correction rollers in the width direction with the medium nipped by the first positional correction rollers and the second positional correction rollers.

2. The medium transport device according to claim 1, further comprising:

a medium transport member disposed along the arcuate transport path and configured to nip and transport the medium, wherein, during correction of the position of the medium in the width direction by the positional correction rollers, a portion of the medium transport member disposed on an outer side of an arc of the arcuate transport path is separated from the medium.

3. The medium transport device according to claim 1, wherein the inclination correction rollers adjoin the positional correction rollers on the upstream side in the transport direction.

4. The medium transport device according to claim 2, wherein the inclination correction rollers adjoin the positional correction rollers on the upstream side in the transport direction.

5. The medium transport device according to claim 3, further comprising:

medium transport members disposed on an upstream side of the inclination rollers in the transport direction and configured to nip and transport the medium, wherein, during correction of the inclination of the medium by the inclination correction rollers, the medium transport members are separated from the medium.

6. The medium transport device according to claim 4, further comprising:

medium transport members disposed on an upstream side of the inclination rollers in the transport direction and configured to nip and transport the medium, wherein, during correction of the inclination of the medium by the inclination correction rollers, the medium transport members are separated from the medium.

7. The medium transport device according to claim 5, wherein the medium transport members to be separated from the medium during the correction of the inclination of the medium by the inclination correction rollers are selected based on a length of the medium in the transport direction.

8. The medium transport device according to claim 6, wherein the medium transport members separated from the medium during the correction of the inclination of the medium by the inclination correction rollers are selected based on a length of the medium in the transport direction.

9. An image forming apparatus comprising:

the medium transport device according to claim 1 configured to transport a medium; and an image former configured to form an image on the medium.

10. A medium transport device comprising:

positional correction means for transporting a medium and correcting a position of the medium in a width direction of the medium by moving the medium in the width direction; and inclination correction means for transporting the medium and correcting an inclination of the medium relative to a transport direction of the medium on an upstream side of the positional correction means in the transport direction, the inclination correction means being disposed at a position where the medium is transported in a flat posture, wherein the positional correction means comprises:

a first positional correction means configured to nip and transport the medium; and a second positional correction means disposed on an upstream side of the first positional correction means across an arcuate transport path for the medium and configured to nip and transport the medium, and the positional correction means is configured to correct the position of the medium in the width direction by moving the first positional correction means and the second positional correction means in the width direction with the medium nipped by the first positional correction means and the second positional correction means.

* * * * *